US008041261B2

(12) United States Patent
Moon et al.

(10) Patent No.: US 8,041,261 B2
(45) Date of Patent: Oct. 18, 2011

(54) IMAGE FORMING APPARATUS WITH A LIGHT SCANNING LAMP BLOCKING DEVICE, OPERATING METHOD THEREOF AND A CARTRIDGE USABLE WITH THE IMAGE FORMING APPARATUS

(75) Inventors: Ji-won Moon, Suwon-si (KR); Hyun-wook Bae, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 719 days.

(21) Appl. No.: 11/939,035

(22) Filed: Nov. 13, 2007

(65) Prior Publication Data

US 2008/0193163 A1 Aug. 14, 2008

(30) Foreign Application Priority Data

Feb. 8, 2007 (KR) ..... 10-2007-0013433

(51) Int. Cl.
*G03G 21/00* (2006.01)

(52) U.S. Cl. ..... 399/128; 399/192

(58) Field of Classification Search ..... 399/50, 399/128, 192
See application file for complete search history.

(56) References Cited

U.S. PATENT DOCUMENTS 4,627,703 A * 12/1986 Suzuki et al.
4,943,815 A * 7/1990 Aldrich et al.
2002/0039497 A1* 4/2002 Yasuda et al.
2003/0156856 A1* 8/2003 Arimitsu et al.

FOREIGN PATENT DOCUMENTS

| | | |
|---|---|---|
| JP | 8-44161 | 2/1996 |
| JP | 9-33845 | 2/1997 |
| JP | 11-296028 | 10/1999 |
| JP | 2005-250325 | 9/2005 |
| KR | 2006-6648 | 1/2006 |

OTHER PUBLICATIONS

Korean Office Action issued Jun. 23, 2011 in KR Application 10-2007-0013433.

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming apparatus includes a photosensitive body, a light scanning lamp, and a lamp controller. The image forming apparatus has a surface capable of accepting an electric potential. The light scanning lamp can scan a lamp light toward the photosensitive body to change the electric potential of the photosensitive body. The lamp controller moves between a blocking position to block the lamp light from reaching the surface of the photosensitive body, and an unblocking position that is spaced from the blocking position and allows the lamp light to reach the surface of the photosensitive body.

23 Claims, 15 Drawing Sheets

IMAGE FORMING APPARATUS WITH A LIGHT SCANNING LAMP BLOCKING DEVICE, OPERATING METHOD THEREOF AND A CARTRIDGE USABLE WITH THE IMAGE FORMING APPARATUS

CROSS-REFERENCE TO RELATED APPLICATIONS

This application claims priority from Korean Patent Application No. 10-2007-0013433, filed on Feb. 8, 2007, in the Korean Intellectual Property Office, the disclosure of which is incorporated herein by reference.

BACKGROUND OF THE INVENTION

1. Field of the Invention

The present general inventive concept relates to an image forming apparatus, and more particularly, to an image forming apparatus which selectively blocks lamp light of a scanning lamp to change an electric potential of a photosensitive body.

2. Description of the Related Art

An electrophotographic image forming apparatus forms an image on a printing medium through charging, exposing, developing, transferring and fixing processes. Electrophotographic image forming apparatuses include a laser printer, a photocopier, a multifunction printer, etc.

As shown in FIGS. 1 and 2, a conventional image forming apparatus 1 includes a plurality of light scanning lamps 10, developing cartridges 20C and 20K, transfer rollers 33C and 33K, and light scanning devices 43C and 43K. Here, the reference numeral 35 refers to a photosensitive body screen, and reference numerals 25K and 25C refer to cleaning blades.

The respective developing cartridges 20C and 20K include casings 24C and 24K which store cyan and black toners, respectively. The casings 24C and 24K respectively accommodate charging rollers 21C and 21K, developing rollers 22C and 22K, and photosensitive bodies 23C and 23K. The image forming apparatus 1 further includes duplicate structures for yellow and magenta developing, including developing cartridges (not shown) which store yellow and magenta toners respectively, to form a color image.

The photosensitive bodies 23C and 23K are charged by the charging rollers 21C and 21K to a predetermined surface potential. The light scanning devices 43C and 43K scan light corresponding to cyan and black image information, to a surface of the charged photosensitive bodies 23C and 23K. Thus, an electrostatic latent image is formed on the photosensitive bodies 23C and 23K corresponding to the cyan and black image information.

The electrostatic latent image is developed with cyan and black toners by the developing rollers 22C and 22K to form a visible image with the cyan and black toners on the photosensitive bodies 23C and 23K.

With the foregoing method, yellow and magenta visible images are also formed on photosensitive bodies (not shown) accommodated in yellow and magenta developing cartridges (not shown).

The yellow, magenta, cyan and black visible toner images formed on the respective photosensitive bodies are superimposed and transferred to a printing medium P moving between the photosensitive bodies and the transfer rollers, thereby forming a full color image.

The electrostatic latent image remaining on the photosensitive bodies after being transferred to the printing medium P is exposed by the light scanning lamp 10 to be erased. The light scanning lamp 10 includes a light emitting diode (LED) and emits a charge erasing light in a lengthwise direction of the respective photosensitive bodies. Japanese Patent Publication No. 2006-30856, hereby incorporated by reference, discloses a charge erasing method, and thus the detailed description thereof will be avoided here.

If a user opens a cover, power of the light scanning lamp 10 should be turned off. However, if the light scanning lamp 10 malfunctions and keeps emitting light, a user may be exposed to the light directly.

Also, the photosensitive bodies 23C and 23K of the developing cartridges 20C and 20K may be damaged due to the malfunction of the light scanning lamp 10.

Furthermore, impurities which are introduced by the open cover may be attached to the light scanning lamp 10, thereby contaminating the light scanning lamp 10.

SUMMARY OF THE INVENTION

Accordingly, it is an aspect of the present general inventive concept to provide an image forming apparatus which prevents a user from being exposed to light even if a light scanning lamp malfunctions.

Also, it is another aspect of the present general inventive concept to provide an image forming apparatus which minimizes a damage to a photosensitive body even if a light scanning lamp malfunctions.

Further, it is another aspect of the present general inventive concept to provide an image forming apparatus which prevents a light scanning lamp from being contaminated by impurities.

Additional aspects and utilities of the present general inventive concept will be set forth in part in the description which follows and, in part, will be obvious from the description, or may be learned by practice of the present general inventive concept. One or more of these aspects, may be combined with one another or may be utilized individually.

The foregoing and/or other aspects and utilities of the present general inventive concept can be achieved by providing an image forming apparatus, including a photosensitive body of which surface has an electric potential, a light scanning lamp which scans a lamp light toward the photosensitive body to change the electric potential of the photosensitive body, and a lamp controller which moves between a blocking position to block the lamp light from reaching the surface of the photosensitive body, and an unblocking position which is spaced from the blocking position and allows the lamp light to reach the surface of the photosensitive body.

The image forming apparatus may further include a main body which accommodates the photosensitive body, the light scanning lamp and the lamp controller therein, and a moving member which is movably provided to be spaced from and approach the main body.

The lamp controller may include a lamp supporter which supports the light scanning lamp, and a light blocking member which is formed on an optical path between the light scanning lamp and the surface of the photosensitive body, and moves together with the movement of the moving member to be movable between the blocking position and the unblocking position.

The main body may be formed with an opening, and the moving member includes a cover to open and close the opening.

The image forming apparatus may further include a transmitter which is disposed between the moving member and the light blocking member, and moves together with the movement of the moving member to move the light blocking member.

The moving member may include an actuator which protrudes toward the photosensitive body.

The transmitter of the image forming apparatus may include a link which contacts and separates from the actuator to move the light blocking member between the unblocking position and the blocking position.

The link may include a first link which rotates between a first position and a second position by contacting and separate from the actuator, and a second link which is connected with the first link, and moves the light blocking member between the unblocking position and the blocking position as the first link moves between the first position and the second position.

The image forming apparatus may further include a main body which accommodates the photosensitive body, the light scanning lamp and the lamp controller and is formed with an opening, and a cover which is provided to open and close the opening.

The lamp controller may include a light source supporter which supports the light scanning lamp and moves between the blocking position and the unblocking position together with opening and closing operation of the cover.

The light source supporter may be rotatable.

The light source supporter may be slidable.

The foregoing and/or other aspects and utilities of the present general inventive concept can also be achieved by providing a method of operating an image forming apparatus, comprising charging a photosensitive body, exposing the photosensitive body to light to create an electrostatic latent image on the photosensitive body, applying developer to the photosensitive body to create a visible image on the photosensitive body, transferring the visible image to a printing medium, exposing the photosensitive body with light from a light scanning lamp to remove the electrostatic latent image remaining on the photosensitive body, interposing a light blocking element between the light scanning lamp and the photosensitive body to interrupt a light path between the light scanning lamp and the photosensitive body.

The foregoing and/or other aspects and utilities of the present general inventive concept can also be achieved by providing an image forming apparatus comprising a photosensitive body, an exposure unit including a light source to selectively exposing the photosensitive body to create an electrostatic latent image on the photosensitive body, an erasing unit including a light source to expose the photosensitive body to thereby remove the electrostatic latent image, and a screen which is selectively interposed between the light source of the erasing unit and the electrostatic latent image.

The foregoing and/or other aspects and utilities of the present general inventive concept can also be achieved by providing a cartridge usable with an image forming apparatus, comprising a case, a photosensitive body disposed in the case, a lamp light through hole formed on the case to receive light from an external light scanning lamp, and a controller disposed in the case to correspond to the lamp light through hole to selectively allow or block the lamp light through hole from the external light scanning lamp according to an external force exerted on the controller.

The foregoing and/or other aspects and utilities of the present general inventive concept can also be achieved by providing an image forming apparatus comprising a housing, a photosensitive body disposed in the housing, a light scanning lamp to output light toward the photosensitive body, a lamp light through hole formed on the housing to receive the light from the light scanning lamp a controller to selectively open or block the lamp light through hole, and a cover attached to the housing to exert a force to the controller to open and block the lamp light through hole.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
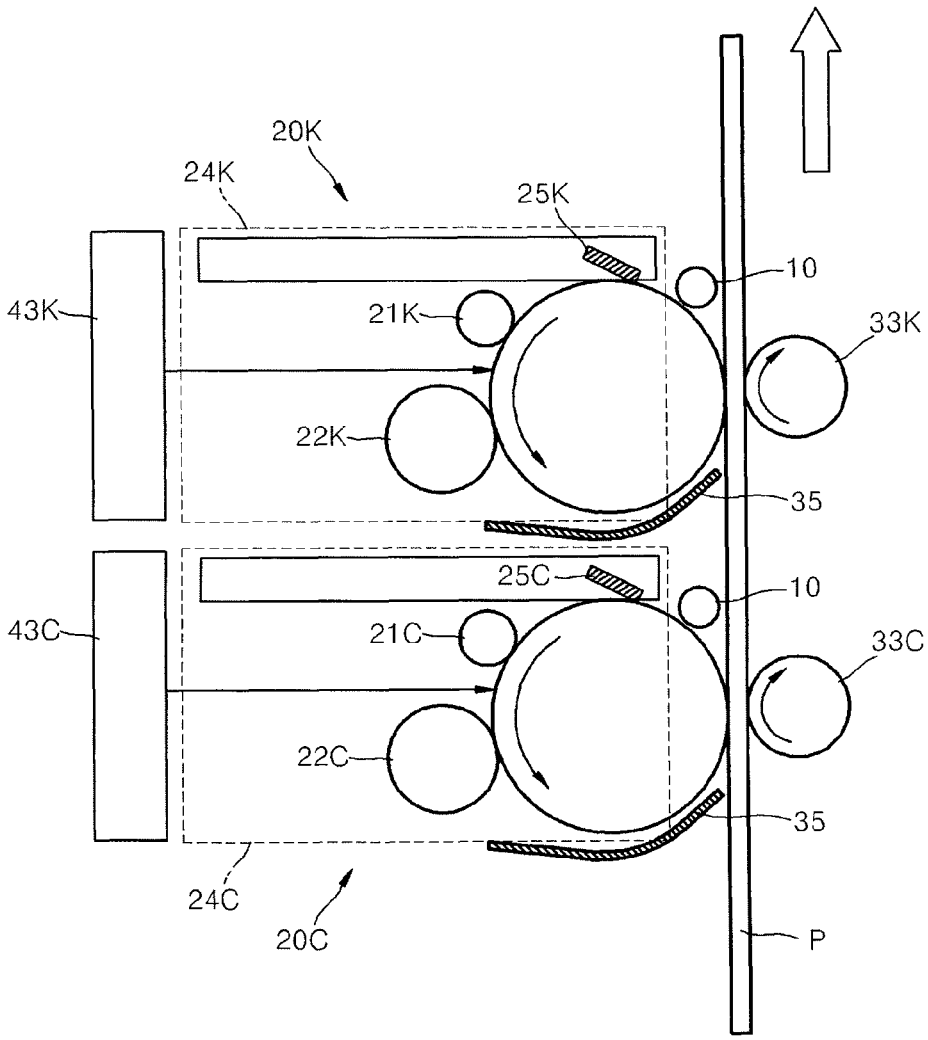
FIG. 1 (RELATED ART)
FIG. 1 is a schematic sectional view of main parts of a conventional image forming apparatus.
Figure 2:
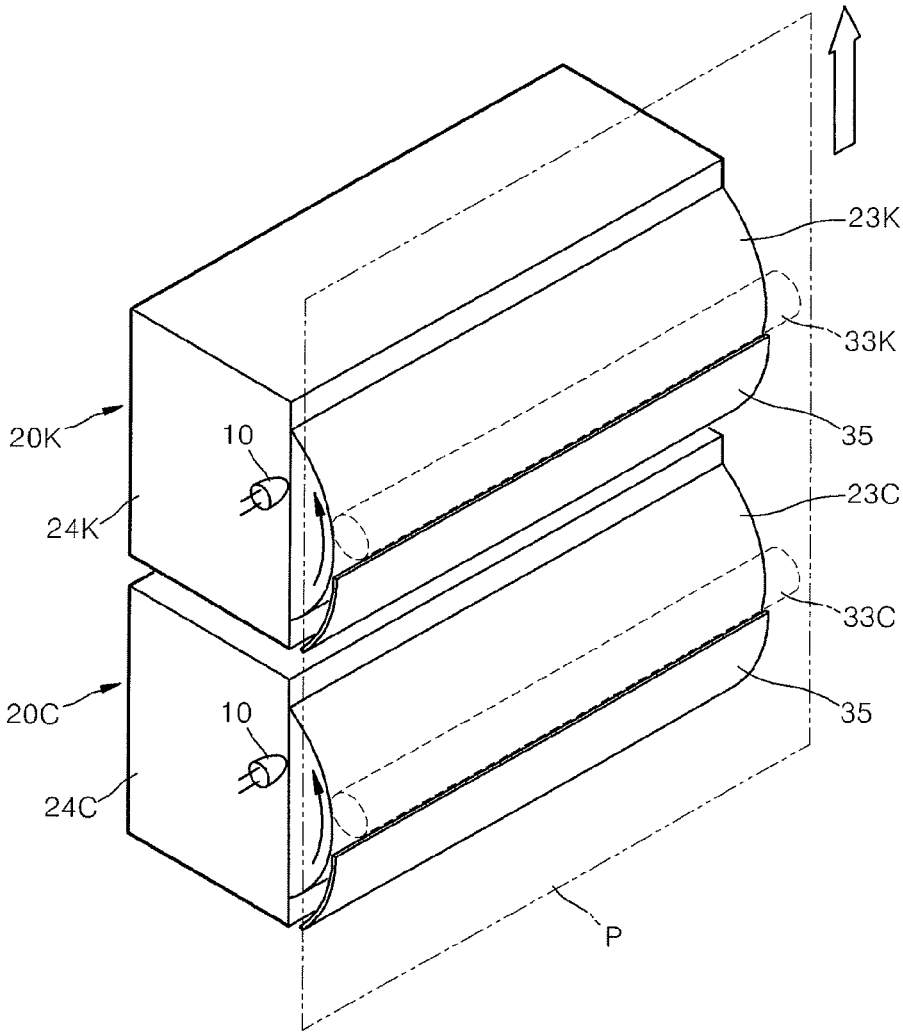
FIG. 2 (RELATED ART)
FIG. 2 is a perspective view of the main parts of the conventional image forming apparatus in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3A:
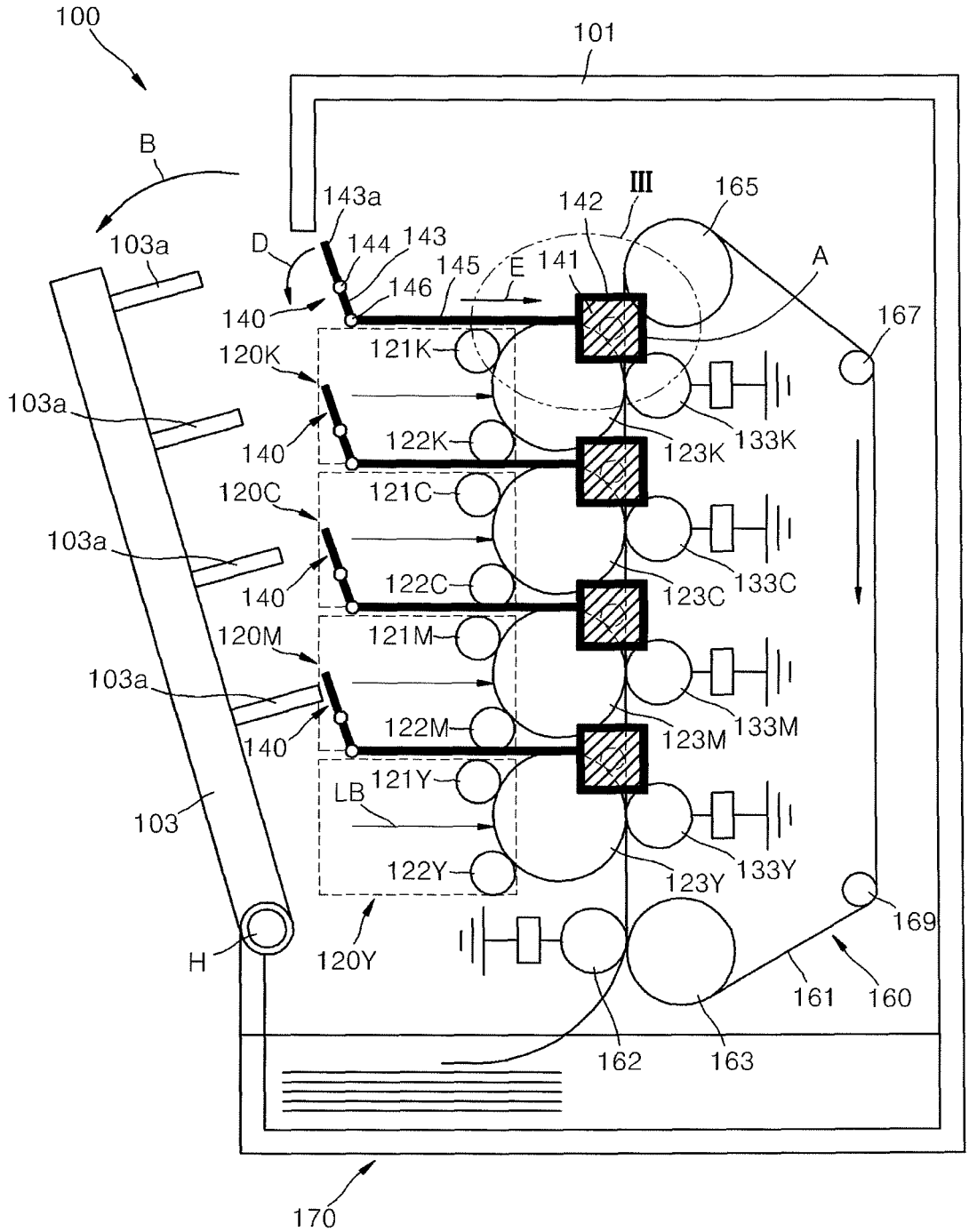
FIGS. 3A and 3B are a schematic sectional view and a main parts plan view respectively of an image forming apparatus according to an exemplary embodiment when a cover is open.
Figure 3B:
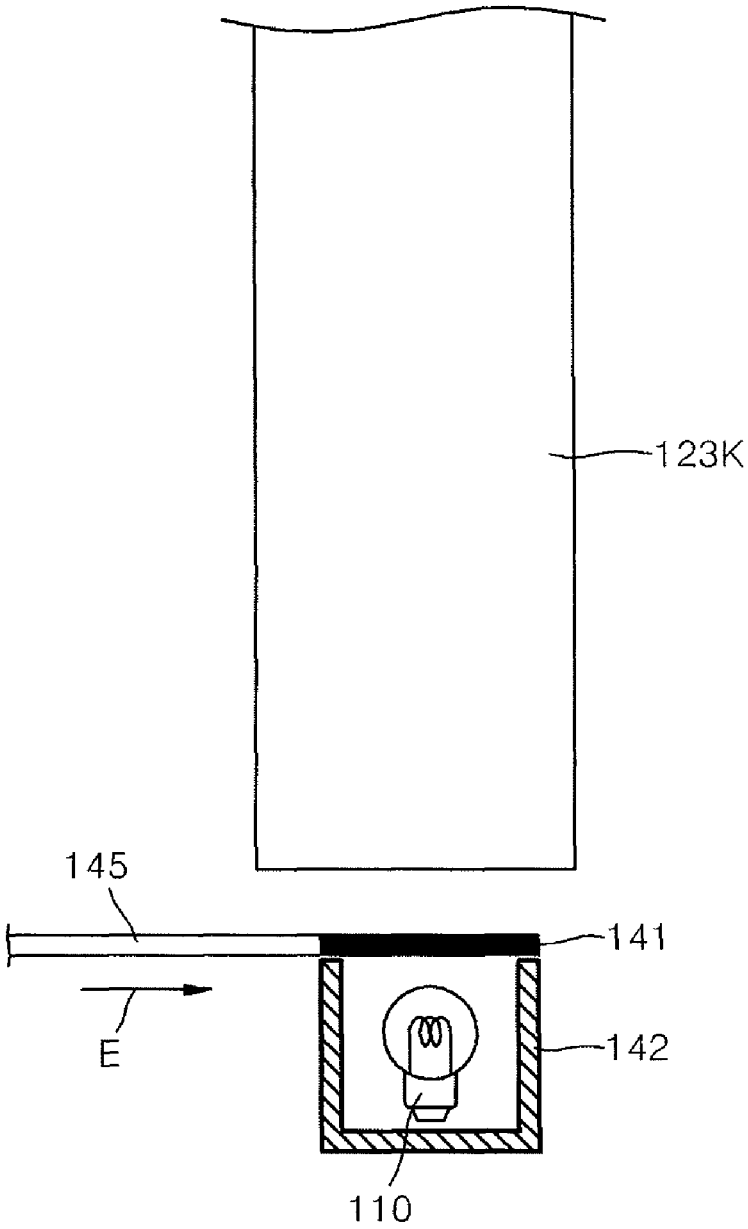
Figure 4A:
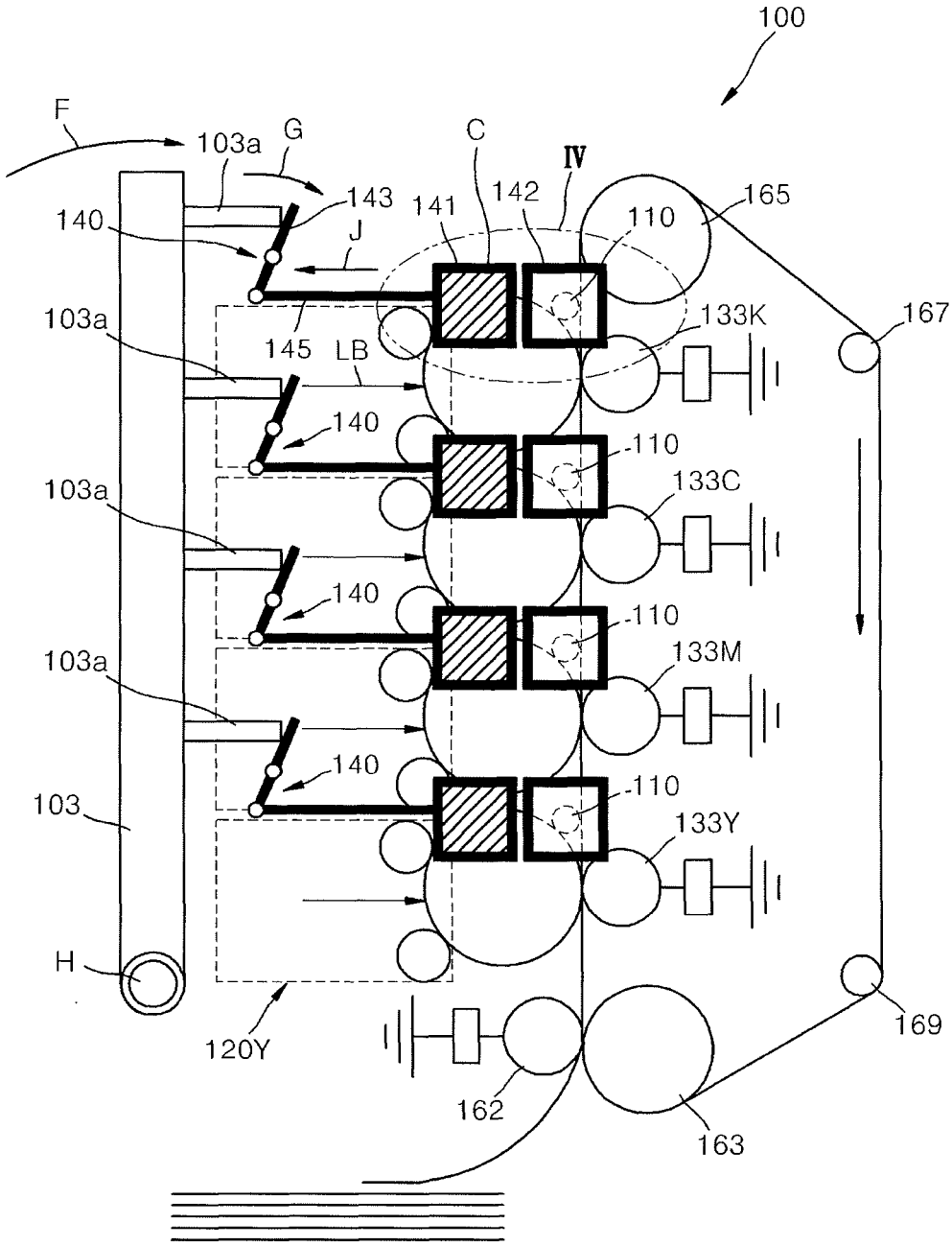
FIGS. 4A and 4B are a schematic sectional view and a main parts plan view respectively of the image forming apparatus in FIG. 3A, when the cover is closed.
Figure 4B:
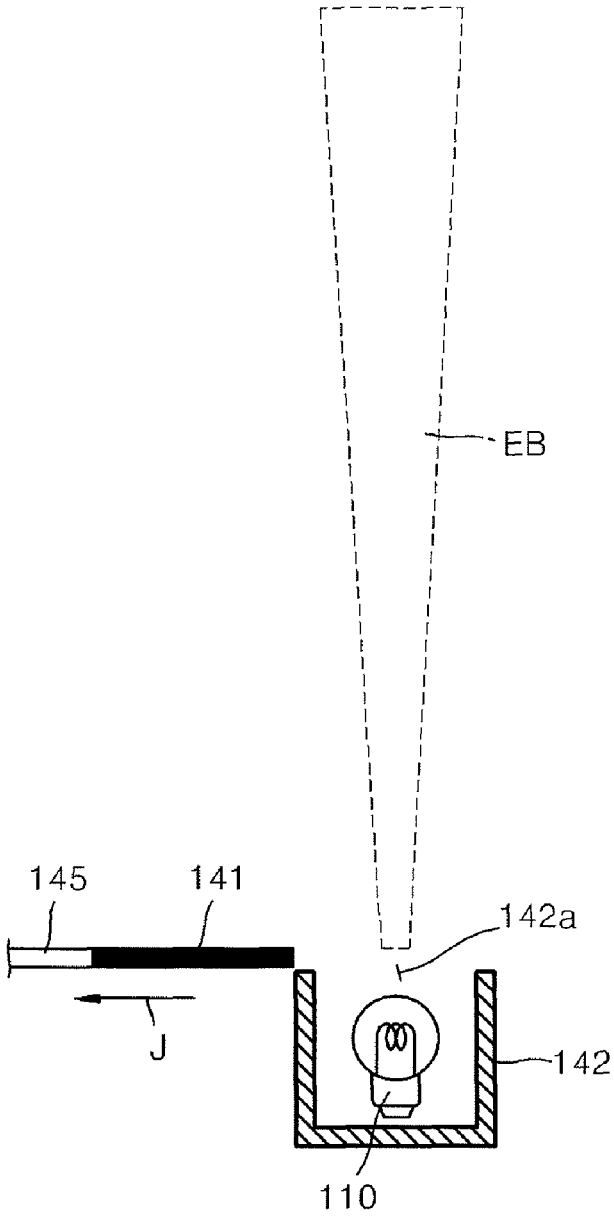
Figure 5:
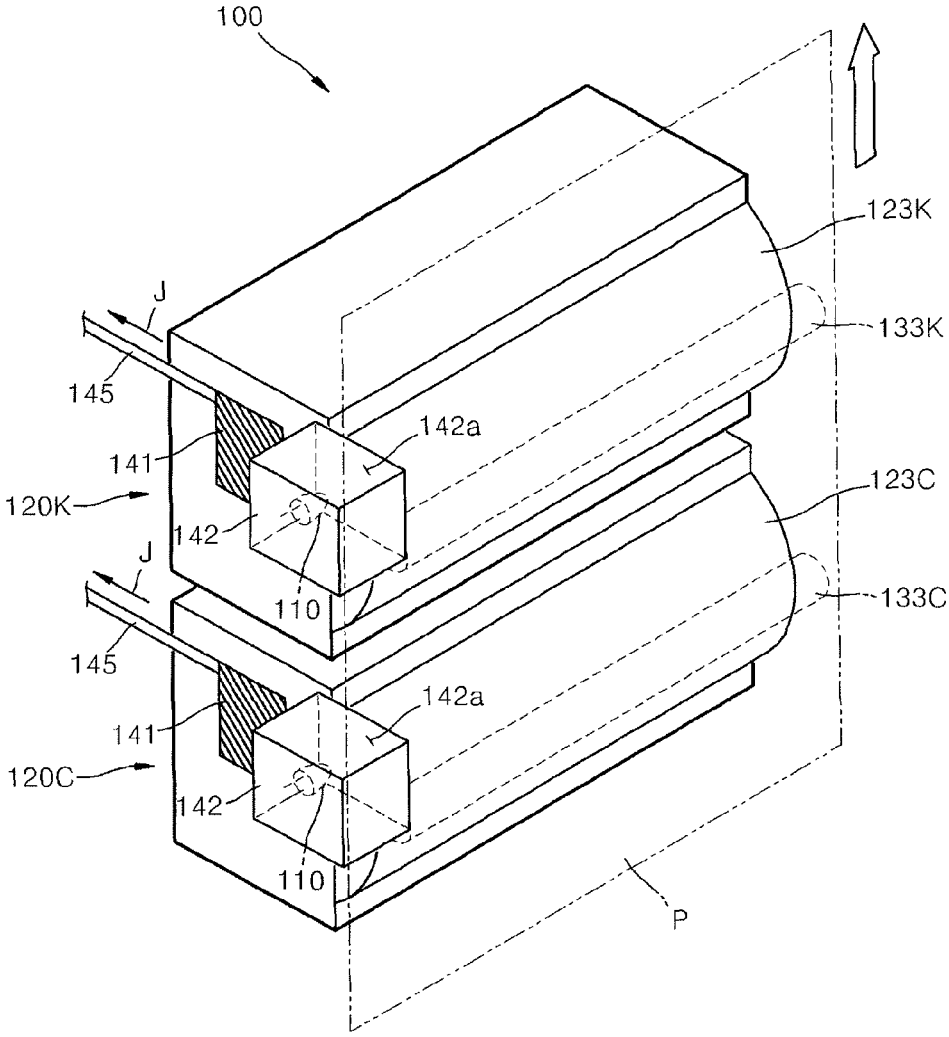
FIG. 5 is a perspective view of main parts of the image forming apparatus in FIG. 4A.

FIG. 3A is a lateral sectional view of an image forming apparatus when a cover 103 is open. FIG. 3B is a plan view of a part III in FIG. 3A. FIG. 4A is a lateral sectional view of the image forming apparatus when the cover 103 is closed. FIG. 4B is a plan view of a part IV in FIG. 4A. For convenience, FIG. 4A does not illustrate the main body 101 and the paper feeding cassette 170 in FIG. 3A.

As shown in FIGS. 3A to 5, an image forming apparatus 100 according to a first exemplary embodiment includes the main body 101, the cover 103, a plurality of light scanning lamps 110, developing cartridges 120Y, 120M, 120C and 120K, transfer rollers 133Y, 133M, 133C and 133K, a plurality of light scanning lamp controllers 140, a printing medium mover 160, and the paper feeding cassette 170.

The printing medium mover 160 moves a printing medium loaded in the paper feeding cassette 170 to be sandwiched between photosensitive bodies 123Y, 123M, 123C and 123K (hereinafter, the reference numerals to be abbreviated to 123) of the developing cartridges 120Y, 120M, 120C and 120K (hereinafter, the reference numerals to be abbreviated to 120), and respective ones of the transfer rollers 133Y, 133M, 133C and 133K (hereinafter, the reference numerals to be abbreviated to 133).

The printing medium mover 160 includes a medium moving belt 161, a medium adsorbing roller 162 which generates static electricity to the printing medium so that the printing medium is attached to the medium moving belt 161, a driving roller 165 which drives the medium moving belt 161, and a plurality of driven rollers 163, 167 and 169.

The cover 103 is movably provided to open and close an opening of the main body 101. As shown in FIGS. 3A and 4A, the cover 103 is rotatable to open (B) and close (F) by a hinge H. The cover 103 may be slidably or pivotally provided as desired.

The cover 103 includes plural actuators 103*a* each of which protrudes to the inside of the main body 101, i.e., toward the photosensitive bodies 123. The number of actuators 103*a* corresonds to the number of the light scanning lamps 110.

Each of the developing cartridges 120 includes a cartridge casing (not shown) which stores a toner of a predetermined color, a charging roller 121 which is mounted in the cartridge casing, a developing roller 122 and the photosensitive body 123.

The light scanning lamp 110 may be provided as one light emitting diode (LED) adjacent to each of the photosensitive bodies 123. As shown in FIGS. 3B and 4B, the light scanning lamp 110 may be provided at a lateral side of the photosensitive body 123K to emit lamp light EB along a lengthwise direction of the photosensitive body 123K.

The number of light scanning lamp controllers 140 correspond to the number of the photosensitive bodies 123 from which electric charge is erased.

As shown in FIGS. 3A and 3B, the light scanning lamp controller 140 includes a light blocking member 141, a light scanning lamp supporter 142, a first link 143 and a second link 145.

The light blocking member 141 is formed adjacent to an optical path between the light scanning lamp 110 and a surface of the photosensitive body 123, and moves between a blocking position and an unblocking position as shown in FIGS. 3B and 4B. The light blocking member 141 may be provided to block all or a portion of the lamp light which is emitted from the light scanning lamp 110 when the light blocking member moves to the blocking position.

In FIG. 3B, light blocking member 141 is positioned at the blocking position to block the lamp light from reaching the surface of the photosensitive body 123. In FIG. 4B, the light blocking member 141 is positioned at the unblocking position, spaced apart from the blocking position, to allow the lamp light to reach the surface of the photosensitive bodies 123.

The light scanning lamp supporter 142 is provided in a frame (not shown) and supports the light scanning lamps 110. The light scanning lamp supporter 142 includes a lamp light through-hole 142*a* (refer to FIG. 4B) which is covered and uncovered by the light blocking member 141. The lamp light is emitted in the lengthwise direction of the photosensitive body 123 through the lamp light through-hole 142*a* to erase electric charge from a corresponding photosensitive body 123.

The first link 143 contacts and separates from the actuator 103*a* of the cover 103 and rotates between a first position C (refer to FIG. 4A) and a second position A (refer to FIG. 3A) about a fixed hinge 144. A torsion coil spring (not shown) is provided in the fixed hinge 144 and applies a rotation momentum to the first link 143 so that the first link 143 is biased to rotate counterclockwise (D). Thus, as the actuator 103*a* is released to separate from the first link 143, the first link 143 rotates counterclockwise (D) and moves from the first position C to the second position A.

The first link 143 further includes a first link contactor 143*a* which contacts the actuator 103*a*.

The second link 145 is connected with the first link 143 by a pin 146, and moves the light blocking member 141 between the unblocking position and the blocking position as the first link 143 moves between the first position C and the second position A.

As shown in FIG. 3A, the second link 145 is formed to integrally move with the light blocking member 141.

The image forming apparatus 100 may further include a power supply (not shown) which supplies power to the light scanning lamps 110, a detector (not shown) which detects whether the cover 103 is open or closed, and a controller (not shown) which controls the power supply to turn on/off power of the light scanning lamps 110 according to a signal of the detector if the cover 103 is open or closed.

Instead of the cooperative movement and interaction of the first link 143 with the opening and closing of the cover 103, the image forming apparatus 100 may instead include an electric driving motor which rotates the first link 143 between the first and second positions C and A, or otherwise causes the light blocking member to move from the unblocking position to the blocking position, and a controller (not shown) which controls the electric driving motor according to the signal of the detector.

A process of printing a color image by the image forming apparatus 100 according to the first exemplary embodiment of the present general inventive concept will be described hereinafter. As shown in FIG. 4A, while the cover 103 is closed, each of the printing medium loaded in the paper feeding cassette 170 is picked up by a pick up roller (not shown) and supplied to the printing medium mover 160. The supplied printing medium is moved between the developing cartridges 120 and the transfer rollers 133 by the printing medium mover 160.

The photosensitive body 123Y of the yellow developing cartridge 120Y is exposed to the light LB corresponding to the image information of a yellow color by a light scanning device (not shown), thereby forming an electrostatic latent image on the surface thereof. The electrostatic latent image is developed with a yellow toner by the developing roller 122Y of the yellow developing cartridge 120Y. Thus, a yellow visible toner image of the yellow toner is formed on the surface of the photosensitive body 123Y.

The yellow visible toner image is transferred to the printing medium moved between the photosensitive body 123Y and the transfer roller 133Y, by electrical attraction of the transfer roller 133Y.

After the yellow visible toner image is transferred, the light scanning lamp 110 erases electric charge from the surface of the photosensitive body 123Y. While the cover 103 closes the opening of the main body 101, the actuator 103*a* contacts the first link contactor 143*a*. Thus, the first link 143 has been rotated clockwise (G) by the fixed hinge 144 and has moved the second link 145 in a direction J. As shown in FIG. 4B, the light blocking member 141 is positioned to the unblocking position, and the lamp light of the light scanning lamp 110 reaches the surface of the photosensitive body 123Y to erase the electric charge from the photosensitive body 123Y.

In a similar manner, magenta, cyan and black visible toner images are sequentially formed on the surface of the respective photosensitive bodies 123M, 123C and 123K, and then transferred to the printing medium, superimposed on the yellow visible toner image, thereby forming a full color toner image on the printing medium. The full color toner image is fixed to the printing medium by heat and pressure while passing a fixing unit (not shown). The fixed printing medium is discharged out of the main body 101 to complete a color printing operation.

If a user opens the cover 103 during an image forming process, the cover 103 rotates counterclockwise (B) as shown in FIG. 3A. Then, the first link contactor 143*a* separates from the actuator 103*a*, and the first link 143 elastically rotates counterclockwise (D) by the torsion coil spring. The first link 143 is then positioned at the second position and the second link 145 moves in a direction E, thereby moving the light blocking member 141 to the blocking position to block the lamp light from being emitted to the photosensitive body 123K.

Even if power is supplied to the light scanning lamp 110 while the cover 103 is open, the lamp light is blocked and a user is prevented from being exposed to the lamp light.

Further, the photosensitive body 123 may be prevented from being damaged due to excessive exposure to the lamp light.

Also, the light scanning lamps 110 may be prevented from being contaminated by impurities which are introduced from the outside when the cover 103 is open.

Figure 6A:
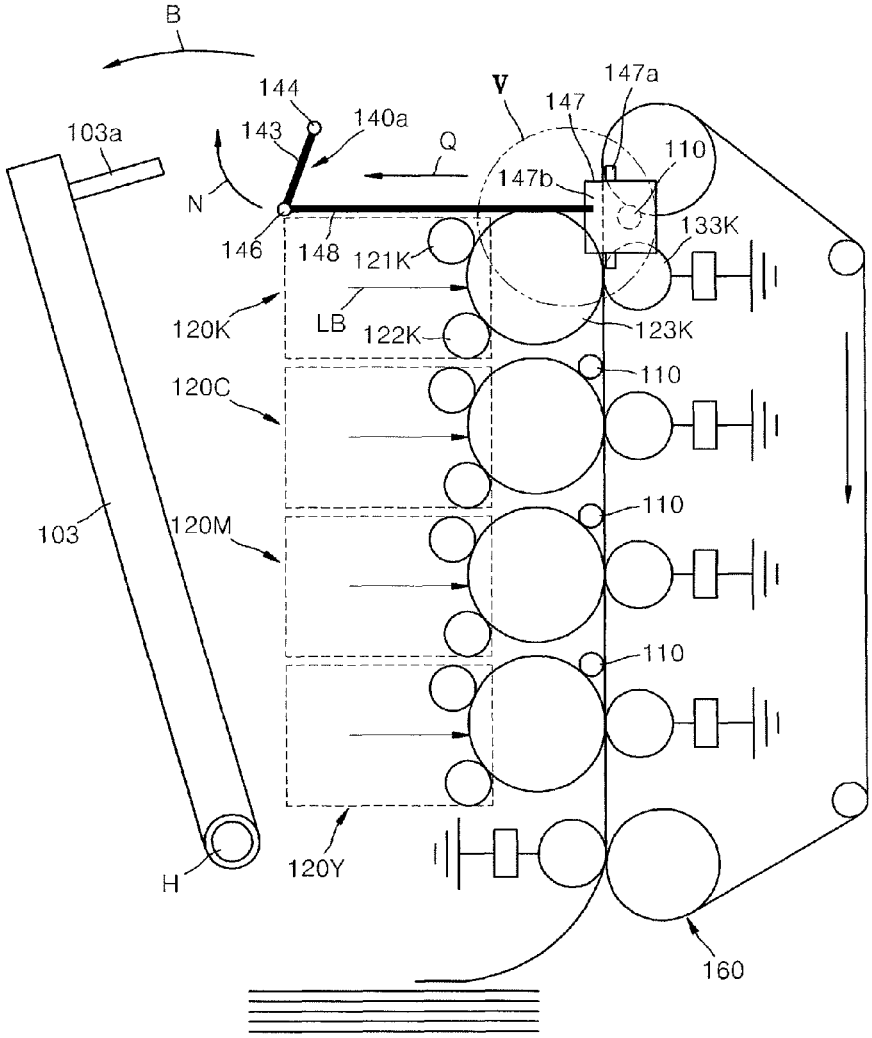
FIGS. 6A and 6B are a schematic sectional view and a main parts plan view respectively of an image forming apparatus according to another exemplary embodiment when a cover is open.
Figure 6B:
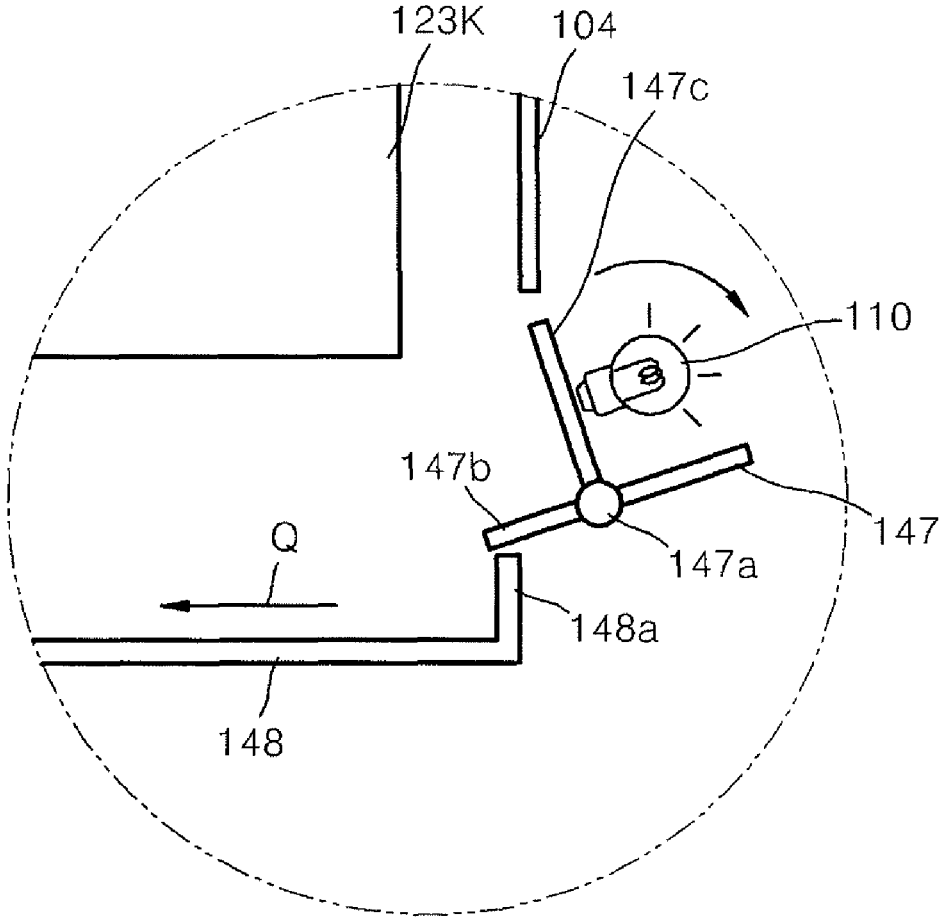
Figure 7A:
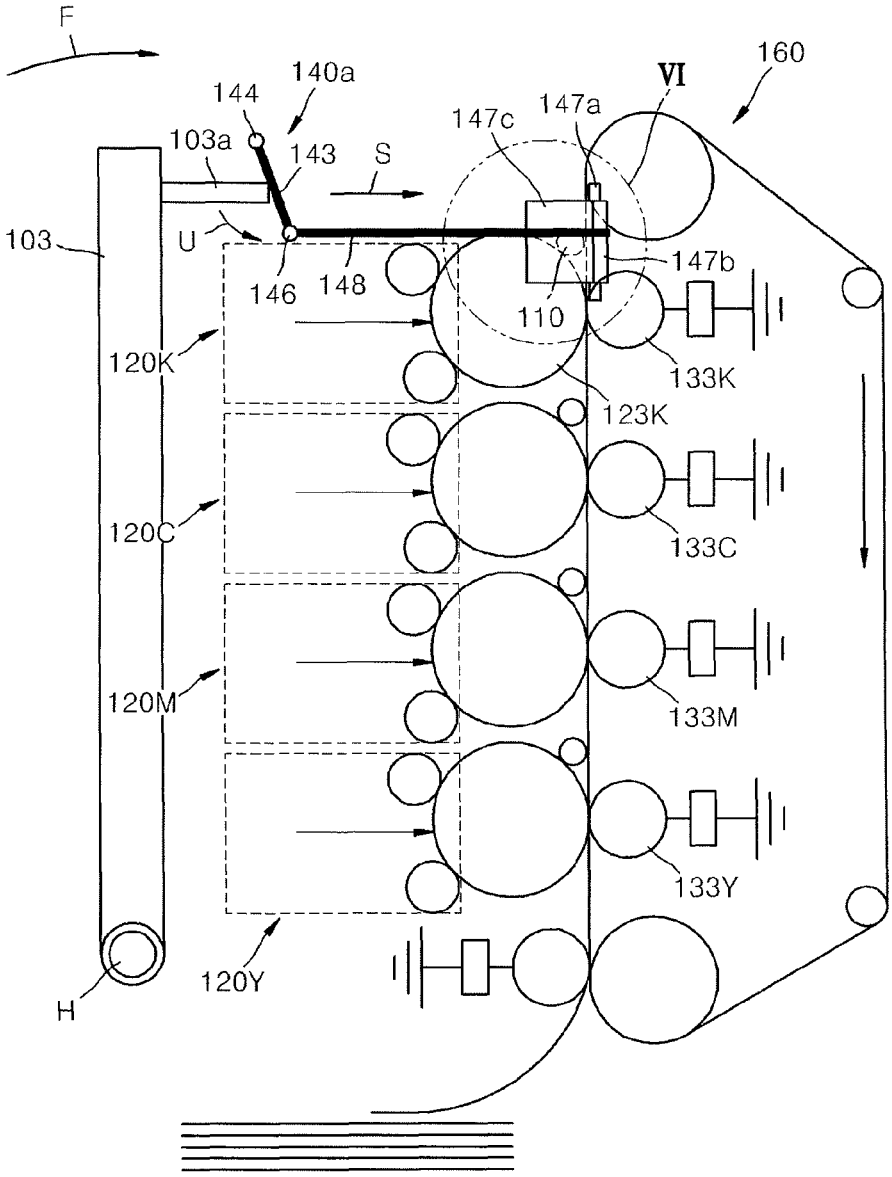
FIGS. 7A and 7B are a schematic sectional view and a main parts plan view of the image forming apparatus in FIG. 6A, when the cover is closed.
Figure 7B:
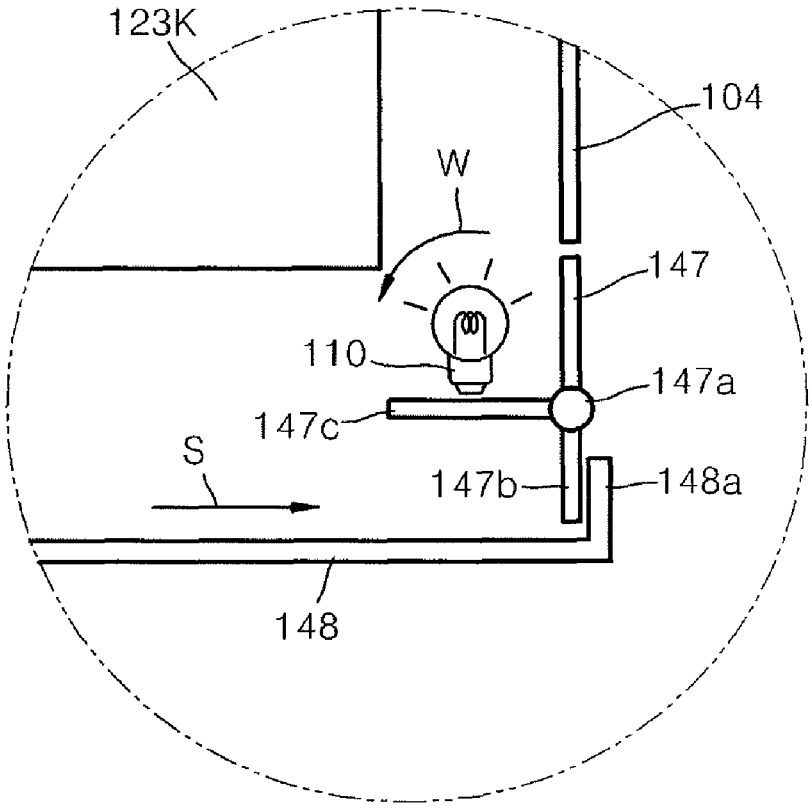

FIGS. 6A, 6B, 7A and 7B illustrate an image forming apparatus according to another exemplary embodiment. FIGS. 6B and 7B are plan views of a part V in FIG. 6A and a part VI in FIG. 7A.

As shown in FIGS. 6A to 7B, an image forming apparatus 100*a* according to includes a lamp controller 140*a*. Other elements are the same as those in the first exemplary embodiment of the present general inventive concept. Thus, the detailed description thereof will be avoided here. For convenience, the lamp controller 140*a* is only illustrated with respect to the light scanning lamp 110 associated with photosensitive body 123K of the black developing cartridge 120K. However, the lamp controller 140*a* is also applicable to the other light scanning lamps associated with the remaining photosensitive bodies 123Y, 123M and 123C.

The lamp controller 140*a* includes a first link 143 which rotates by a fixed hinge 144, a second link 148 which is connected with the first link 143 by a pin 146 and moves together with a rotation of the first link 143 to move a light source supporter 147, and the light source supporter 147.

A torsion coil spring (not shown) is provided in the fixed hinge 144 so that the first link 143 rotates clockwise (N) by the fixed hinge 144 if an actuator 103*a* of a cover 103 separates from the first link 143.

A light source supporter actuating part 148*a* is formed opposite of the pin 146 at the end of the second link 148 to move the light source supporter 147.

As shown in FIG. 6B, the light source supporter actuating part 148*a* may include a projection which protrudes toward the photosensitive body 123K.

The light source supporter 147 is provided to rotate by a rotation pin 147*a*. The light source supporter 147 includes a light source supporting part 147*c* which supports the light scanning lamp 110 and an actuated part 147*b* which is actuated by the light source supporter actuating part 148*a*. The light source supporting part 147*c* and the actuated part 147*b* may integrally move. The light source supporting part 147*c* and the actuated part 147*b* may be formed as a single body as desired.

A torsion coil spring (not shown) may be inserted into the rotation pin 147*a* to supply an elastic force to the light source supporter 147. Thus, the light source supporter 147 rotates counterclockwise W (refer to FIG. 7B) by the rotation pin 147*a*.

Instead of or in addition to first and second links 143 and 148 and actuator 103*a*, The image forming apparatus 100*a* may include an electric driving motor (not shown) which drives the light source supporter 147, a detector (not shown) which detects whether the cover 103 is open or closed, and a controller (not shown) which controls the electric driving motor to rotate the light source supporter 147 between the blocking position and the unblocking position if it is determined by a signal of the detector that the cover 103 is open or closed. The electric driving motor may rotate the light source supporter 147 using first and second lines 143 and 148, or by some other mechanism (e.g., a gear or belt connection between the motor shaft and rotation pin 147*a*).

A process of blocking lamp light of the light scanning lamp 110 when the cover 103 is open while pivotally rotating in a direction B, will be described as follows.

First, if the cover 103 is open while pivotally rotating in the direction B by a hinge H, the first link 143 rotates clockwise (N) and the second link 148 moves in a direction Q accordingly. The light source supporter actuating part 148*a* of the second link 148 rotates the actuated part 147*b* of the light source supporter 147 clockwise so that the light scanning lamp 110 emits lamp light in a direction away from the photosensitive body 123K. The actuated part 147*b* is supported by the light source supporter actuating part 148*a* so that the light source supporter 147 does not rotate clockwise. The image forming apparatus 100*a* may further include a frame 104 to completely block the lamp light of the light scanning lamp 110 from reaching the photosensitive body 123K. The frame 104 may include an opaque material to block light.

As shown in FIGS. 7A and 7B, if the cover 103 is closed while pivotally rotating in a direction F, the first link 143 rotates counterclockwise (U) and the second link 148 moves in a direction S accordingly. As the light source supporter actuating part 148*a* moves in the direction S, the actuated part 147*b* rotates counterclockwise (W). The light scanning lamp 110 thus emits lamp light toward the photosensitive body 123K.

The lamp light is thus selectively emitted to the photosensitive body 123 by changing an emission angle of the light scanning lamp 110 emitting the lamp light.

Thus, the image forming apparatus of this embodiment may provide effects equivalent to those in the previous exemplary embodiment.

FIGS. 8A to 9B illustrate an image forming apparatus according to another embodiment.

Figure 8A:
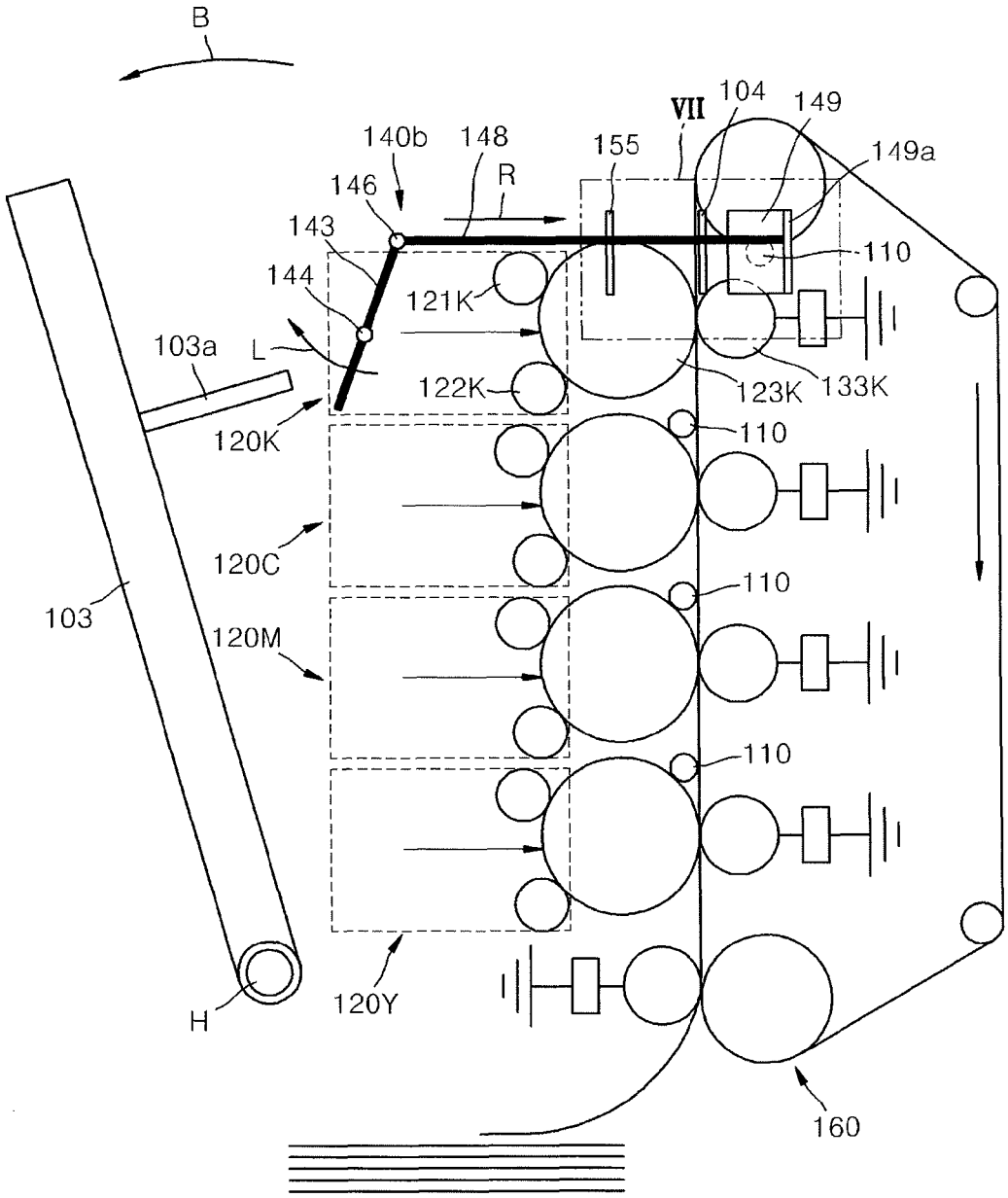
FIGS. 8A and 8B are a schematic sectional view and a main parts plan view of an image forming apparatus according to another exemplary embodiment when a cover is open.
Figure 8B:
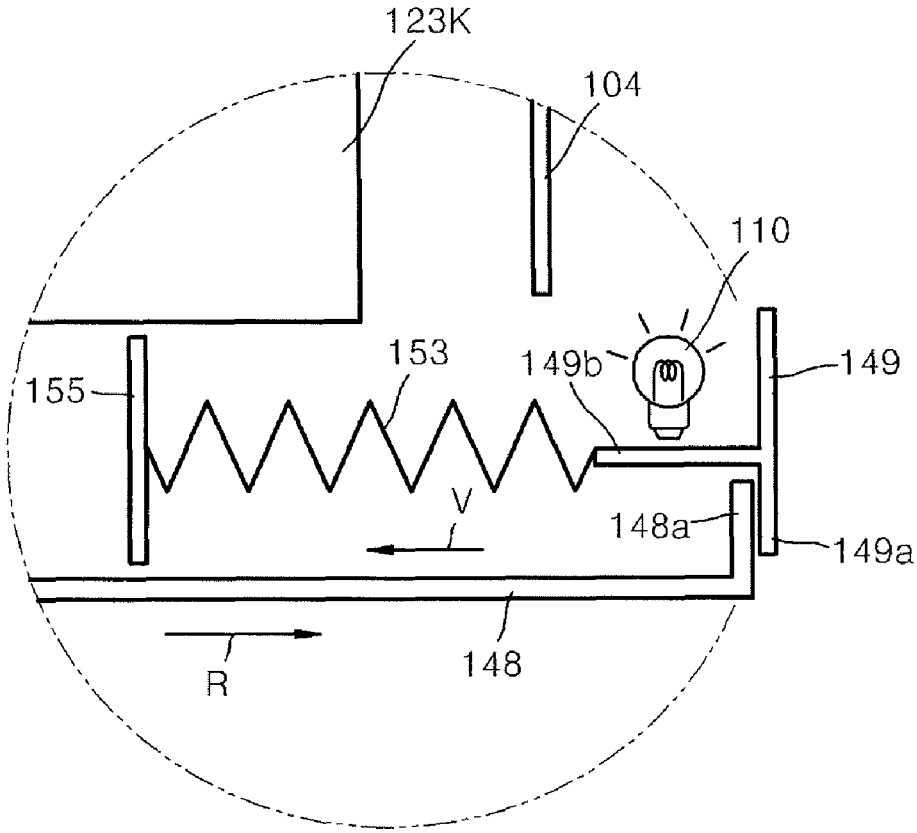
Figure 9A:
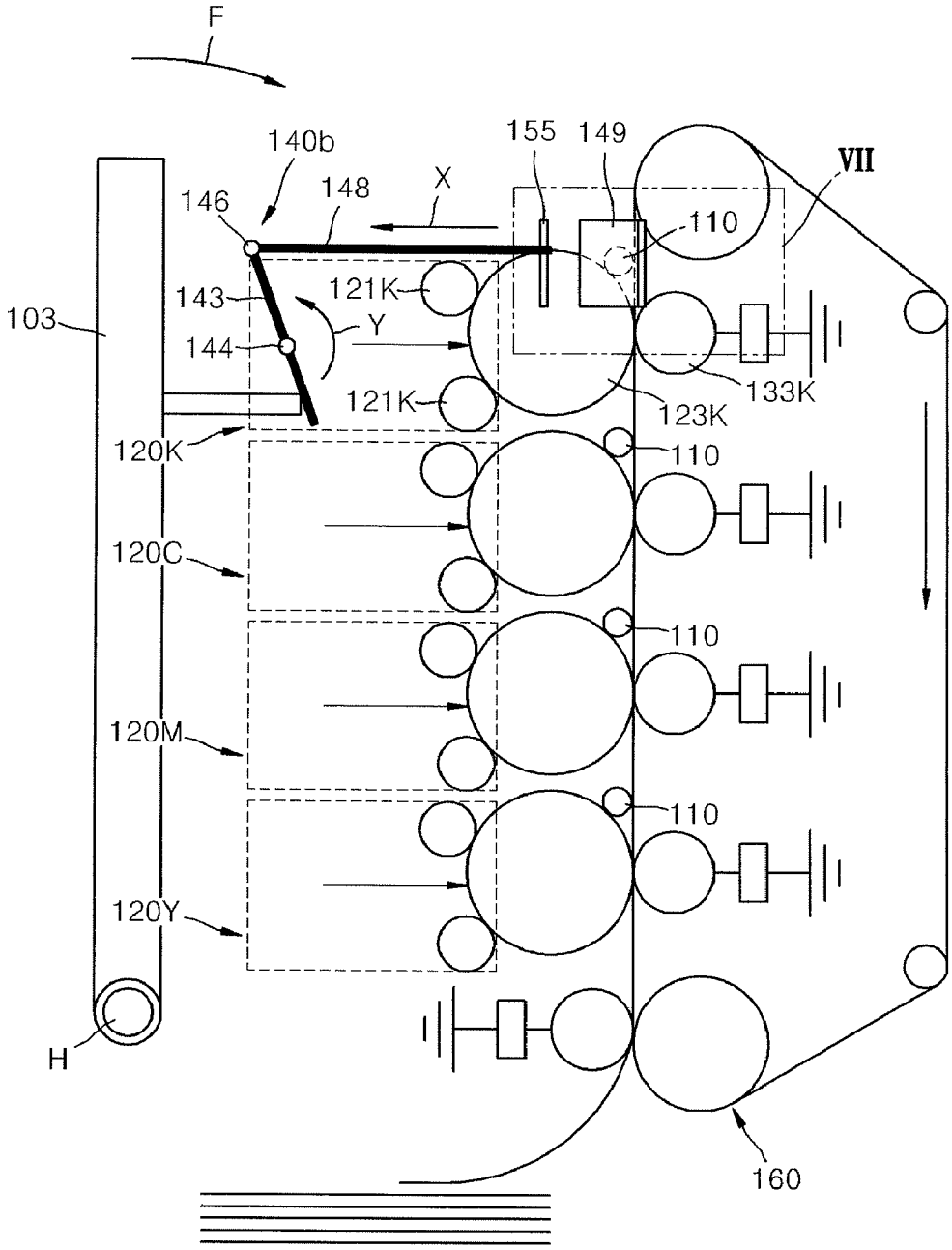
FIGS. 9A and 9B are a schematic sectional view and a main parts plan view of the image forming apparatus in FIG. 8A, when the cover is closed.
Figure 9B:
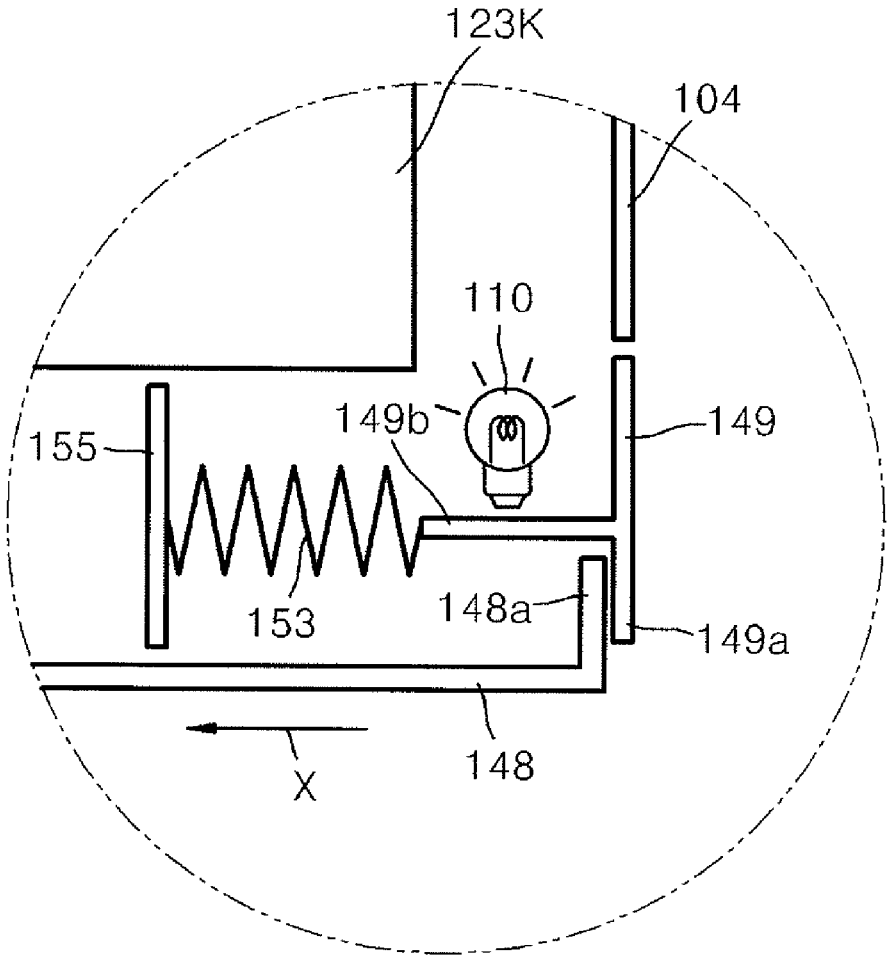

FIGS. 8B and 9B are plan views of a part VII in FIG. 8A and a part VIII in FIG. 9A.

As shown in FIGS. 8A to 9B, an image forming apparatus according to a third exemplary embodiment includes a lamp controller 140*b*, an elastic member 153 and an elastic member supporting frame 155. Other elements are the same as those in the previous embodiment and thus, their detailed description thereof will be avoided here. For convenience, only a single lamp controller 140*b* is illustrated associated with the light scanning lamp 110 which erases electric charge from a photosensitive body 123K. However, the lamp controller 140*b* is also applicable to light scanning lamps associated with the remaining photosensitive bodies 123Y, 123M and 123C.

The lamp controller 140*b* includes a first link 143 which rotates by a fixed hinge 144, a second link 148 which is connected with the first link 143 by a pin 146 and moves together with a rotation of the first link 143 to slidably move a light source supporter 149, and the light source supporter 149.

A torsion coil spring (not shown) is provided in the fixed hinge 144 so that the first link 143 is biased to rotate clockwise (L) by the fixed hinge 144 if an actuator 103*a* of a cover 103 separates from the first link 143.

A light source supporter actuating part 148*a* is formed opposite to the pin 146 on the second link 148 to move the light source supporter 149.

As shown in FIG. 8B, the light source supporter actuating part 148*a* may include a projection which protrudes toward the photosensitive body 123K.

The light source supporter 149 is provided to slidably move in a direction R, a direction transverse to the lengthwise direction of the photosensitive body 123K. A guide (not shown) may be provided to guide the light source supporter 149 to move slidably.

The light source supporter 149 includes a light source supporting part 149*b* which supports the light scanning lamp 110 and an actuated part 149*a* which is actuated by the light source supporter actuating part 148*a*. The light source supporting part 149*b* and the actuated part 149*a* may integrally move. The light source supporting part 149*b* and the actuated part 149*a* may be formed as a single body as desired.

The elastic member 153 is provided between the light source supporter 149 and the elastic member supporting frame 155 to supply an elastic force to the light source supporter 149 so that the light source supporter 149 is biased towards the photosensitive body 123K.

A process of blocking lamp light of the light scanning lamp 110 when the cover 103 is opens and pivotally rotates in a direction B, will be described as follows.

First, if the cover 103 is open while rotating in the direction B by a hinge H, the first link 143 rotates clockwise (L) and the second link 148 moves in a direction R accordingly. The light source supporter actuating part 148*a* of the second link 148 moves the actuated part 149*a* of the light source supporter 149 in the same direction R. Thus, as shown in FIGS. 8A and 8B, the light source supporter 149 slidably moves to a blocking position to block the lamp light of the light scanning lamp 110 from being emitted to the photosensitive body 123K. A frame 104 according to the second exemplary embodiment may further be provided to completely block the lamp light from being emitted to the photosensitive body 123K.

As shown in FIGS. 9A and 9B, if the cover 103 is pivotally rotated in a direction F to close, the first link 143 rotates counterclockwise (Y) and the second link 148 moves in a direction X accordingly. As the light source supporter actuating part 148*a* moves in the direction X, the actuated part 149*a* moves in the same direction X by the elastic force of the elastic member 153. Then, the lamp light of the light scanning lamp 110 is emitted to the surface of the photosensitive body 123K to erase electric charge therefrom.

Thus, the lamp light may be selectively emitted to the photosensitive body 123 by slidably moving the light scanning lamp 110.

According to the present general inventive concept, a cartridge may include a case, the photosensitive body disposed in the case, an opening or lamp light through hole formed on the case to receive light from an external light scanning lamp and a controller disposed in the case to correspond to the opening to selectively allow or block the opening to allow or blocks the light from the external light scanning lamp according to an external force exerted on the controller. The cover and the actuator may be attached to a housing of the image forming apparatus to exert the external force to the controller during opening and closing.

An image forming apparatus as described above may provide one or more of the following effects.

First, a user may be prevented from being exposed to light even if a light scanning lamp malfunctions.

Second, a photosensitive body may be least damaged even if a light scanning lamp malfunctions.

Lastly, a light scanning lamp may be prevented from being contaminated by impurities.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus, comprising:

a photosensitive body that includes a surface with an electric potential;

a light scanning lamp disposed on an end portion of the photosensitive body to radiate lamp light from the end portion of the photosensitive body toward a length wise direction of the photosensitive body to remove an electrostatic latent image on the photosensitive body and to scan the lamp light toward the photosensitive body to change the electric potential of the photosensitive body; and a lamp controller which moves between a blocking position to block all or a portion of the lamp light directed to the surface of the photosensitive body, and an unblocking position which is spaced from the blocking position and allows the lamp light directed to the surface of the photosensitive body to impinge the photosensitive body.

2. The image forming apparatus according to claim 1, further comprising:

a main body which accommodates the photosensitive body, the light scanning lamp and the lamp controller therein; and a moving member which is movably provided to be spaced from and approach the main body.

3. The image forming apparatus according to claim 2, wherein the main body is includes an opening, and the moving member comprises a cover to expose and close the opening.

4. The image forming apparatus according to claim 2, wherein the lamp controller comprises:

a lamp supporter which supports the light scanning lamp; and a light blocking member which is movably positioned between a blocking position and an unblocking position, the light blocking member located to block an optical path between the light scanning lamp and the surface of the photosensitive body when at a blocking position, located to unblock the optical path when at the unblocking position, and moves together with the movement of the moving member to be positioned to the blocking position and the unblocking position.

5. The image forming apparatus according to claim 4, further comprising a transmitter which is disposed between the moving member and the light blocking member, and moves together with the movement of the moving member to move the light blocking member.

6. The image forming apparatus according to claim 5, wherein the moving member comprises an actuator which protrudes toward the photosensitive body.

7. The image forming apparatus according to claim 6, wherein the transmitter comprises a link which contacts and separates from the actuator to move the light blocking member between the unblocking position and the blocking position.

8. The image forming apparatus according to claim 1, further comprising:

a main body which accommodates the photosensitive body, the light scanning lamp and the lamp controller and is formed with an opening; and a cover which is provided to open and close the opening.

9. The image forming apparatus according to claim 8, wherein the lamp controller comprises a light source supporter which supports the light scanning lamp and moves between the blocking position and the unblocking position together with opening and closing operation of the cover.

10. The image forming apparatus according to claim 9, further comprising a transmitter which is disposed between the cover and the light source supporter, and moves together with opening and closing operation of the cover to move the light source supporter.

11. The image forming apparatus according to claim 10, wherein the cover comprises an actuator which protrudes toward the photosensitive body.

12. The image forming apparatus according to claim 11, wherein the transmitter comprises a link which contacts and separates from the actuator to move the light source supporter between the unblocking position and the blocking position.

13. The Image forming apparatus according to claim 10, wherein the light source supporter is movable.

14. A method of operating an image forming apparatus, comprising:

charging a photosensitive body;

exposing the photosensitive body to light to create an electrostatic latent image on the photosensitive body;

applying developer to the photosensitive body to create a visible image on the photosensitive body;

transferring the visible image to a printing medium;

exposing the photosensitive body with light from a light scanning lamp to remove the electrostatic latent image remaining on the photosensitive body, the light scanning lamp disposed on an end portion of the photosensitive body to radiate light from the end portion of the photosensitive body toward a length wise direction of the photosensitive body; and interposing a light blocking element between the light scanning lamp and the photosensitive body to interrupt a light path between the light scanning lamp and the photosensitive body.

15. The method of claim 14, wherein the operation of exposing the photosensitive body with light from a light scanning lamp includes exposing the photosensitive body when the light scanning lamp is in a first position; and the operation of interposing includes moving the light scanning lamp from a first position to a second position.

16. The method of claim 14, wherein the operation of exposing the photosensitive body with light from a light scanning lamp includes radiating light from the light scanning lamp along the light path, and the operation of interposing includes moving a screen into the light path.

17. The method of claim 14, wherein the operation of interposing includes rotating a light support on which the light scanning lamp is mounted.

18. The method of claim 14, wherein the operation of interposing is initiated by opening a door on a housing of the image forming apparatus.

19. The method of claim 18, wherein the operation of interposing includes sensing when the door of the housing is opened and, in response to sensing when the door of the housing is opened, interposing the light blocking element.

20. The method of claim 18, wherein the operation of interposing includes releasing one of a light support on which the light scanning lamp is mounted and the light blocking element from a first position where the light blocking element is not interrupting the light path to allow movement to a second position where the light blocking element blocks light from the light scanning lamp directed to the photosensitive body.

21. An image forming apparatus comprising:

a photosensitive body;

a laser scanning unit to emit a first light toward the photosensitive body to thereby create an electrostatic latent image on the photosensitive body;

an electric potential changing light source to emit a second light toward the photosensitive body on which the electrostatic latent image is formed to thereby change an electric potential of the photosensitive body; and a screen which is selectively interposed between the electric potential changing light source and the photosensitive body to allow transmission of the second light to change the electric potential of the photosensitive body and to block transmission of the second light such that the electric potential of the photosensitive body does not change.

22. The image forming apparatus of claim 21, wherein the screen includes a base on which the electric potential changing light source is mounted, and wherein the base rotates with the electric potential changing light source for the second light to be selectively directed to the photosensitive body.

23. The image forming apparatus of claim 21, wherein at least one of the electric potential changing light source and the screen is mounted to be moveable.

* * * * *